US006675986B1

(12) United States Patent
Spencer

(10) Patent No.: US 6,675,986 B1
(45) Date of Patent: Jan. 13, 2004

(54) COLD CARE BAG

(76) Inventor: Karin L. Spencer, 20929 Anon La., Southfield, MI (US) 48075

( * ) Notice: Subject to any disclaimer, the term of this patent is extended or adjusted under 35 U.S.C. 154(b) by 61 days.

(21) Appl. No.: 10/108,026

(22) Filed: Mar. 28, 2002

Related U.S. Application Data

(60) Provisional application No. 60/297,977, filed on Jun. 12, 2001.

(51) Int. Cl.[7] ..... A47F 1/00

(52) U.S. Cl. ..... 221/98; 221/199

(58) Field of Search ..... 221/33, 45, 46, 221/48, 61, 63, 199, 97, 102, 98; 206/438, 812, 494

(56) References Cited

U.S. PATENT DOCUMENTS 4,995,530 A * 2/1991 Tabor ..... 221/46
6,579,271 B1 * 6/2003 Aruffo et al. ..... 604/355

* cited by examiner

*Primary Examiner*—Kenneth W. Noland
(74) *Attorney, Agent, or Firm*—Joseph N. Breaux

(57) ABSTRACT

A cold care bag system that includes a housing for holding tissues and the like that is provided with a mechanism for dispensing cold care bags from the roll; each cold care bag being impregnated with disinfectant material such that a user may use a tissue and dispose of the tissue by putting it in a disinfectant impregnated cold care bag, tearing the cold care bag from the roll, sealing the cold care bag, and throwing the sealed cold care bag into the garbage.

1 Claim, 3 Drawing Sheets

COLD CARE BAG

This application claims the benefit of provisional application No. 60/297,977, filed Jun. 12, 2001.

TECHNICAL FIELD

The present invention relates to sanitary products and more particularly to a cold care bag system that includes a housing for holding tissues and the like that is provided with a mechanism for dispensing cold care bags from a roll; each cold care bag being impregnated with disinfectant material such that a user may use a tissue a n d dispose of the tissue by putting it in a disinfectant impregnated cold care bag, tearing the cold care bag from the roll, sealing the cold care bag, and throwing the sealed cold care bag into the garbage.

BACKGROUND ART

Many colds are transferred between individuals because tissues containing germs and the like are simply used and thrown into a garbage can where the air may carry the germs spreading the germs throughout an office, school, or similar location. It would be a benefit, therefore, to have a cold care bag system which would allow individuals to dispose of used tissues immediately after use in a disinfectant impregnated disposal bag.

GENERAL SUMMERY DISCUSSION OF INVENTION

It is thus an object of the invention to provide a cold care bag system that includes a housing for holding tissues and the like that is provided with a mechanism for dispensing cold care bags from a roll; each cold care bag being impregnated with disinfectant material such that a user may use a tissue and dispose of the tissue by putting it in a disinfectant impregnated cold care bag, tearing the cold care bag from the roll, sealing the cold care bag, and throwing the sealed cold care bag into the garbage.

Accordingly, a cold care bag system is provided. The cold care bag system includes a housing for holding tissues and the like that is provided with a mechanism for dispensing cold care bags from a roll; each cold care bag being impregnated with disinfectant material such that a user may use a tissue and dispose of the tissue by putting it in a disinfectant impregnated cold care bag, tearing the cold care bag from the roll, sealing the cold care bag, and throwing the sealed cold care bag into the garbage.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
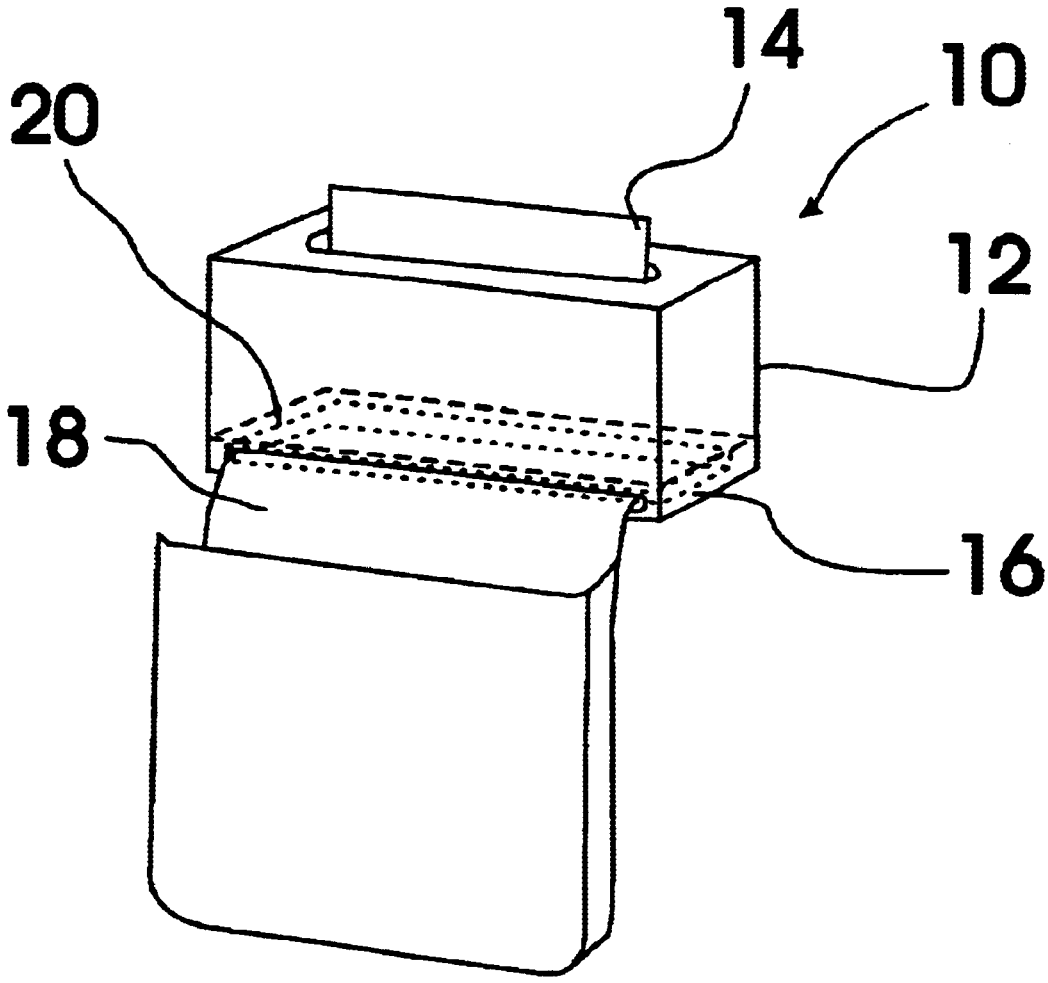
FIG. 1 is a perspective view of an exemplary embodiment of the cold care bag system of the present invention.
Figure 2:
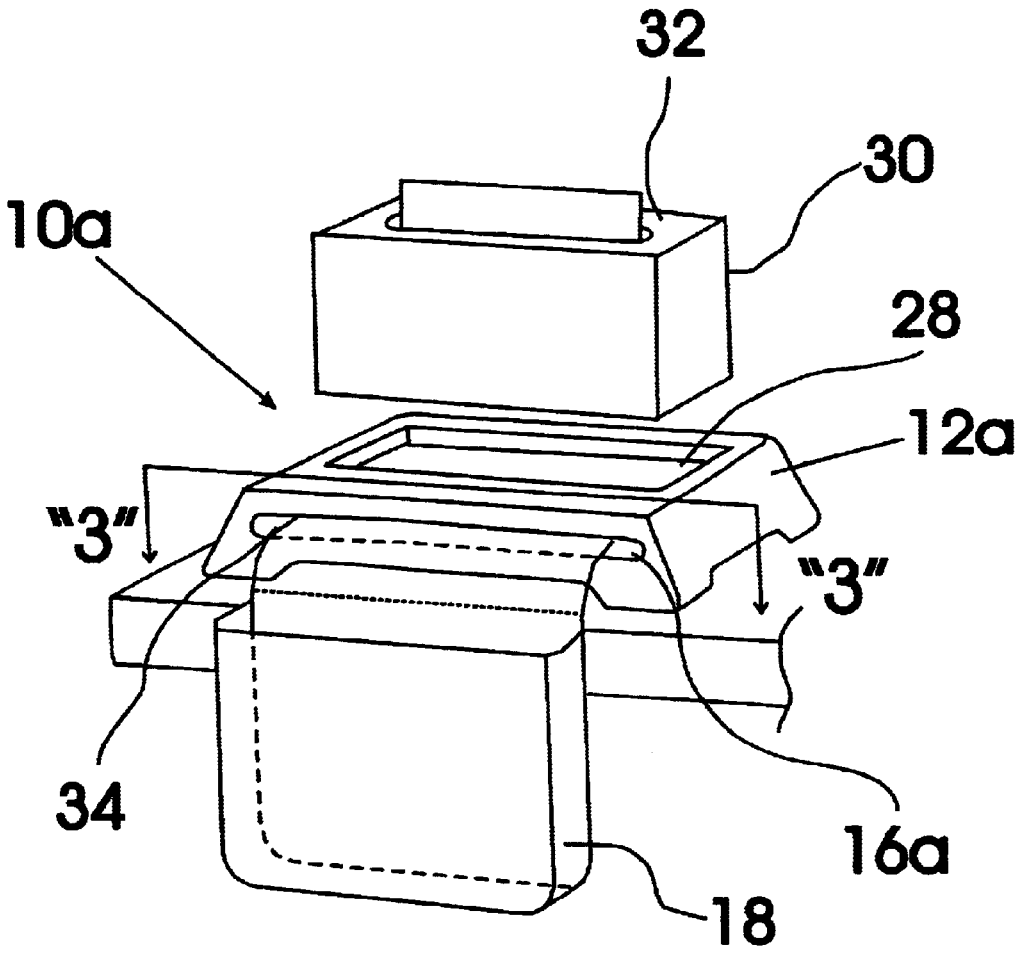
FIG. 2 is a perspective view of a second exemplary embodiment of the cold care bag system of the present invention.
Figure 3:
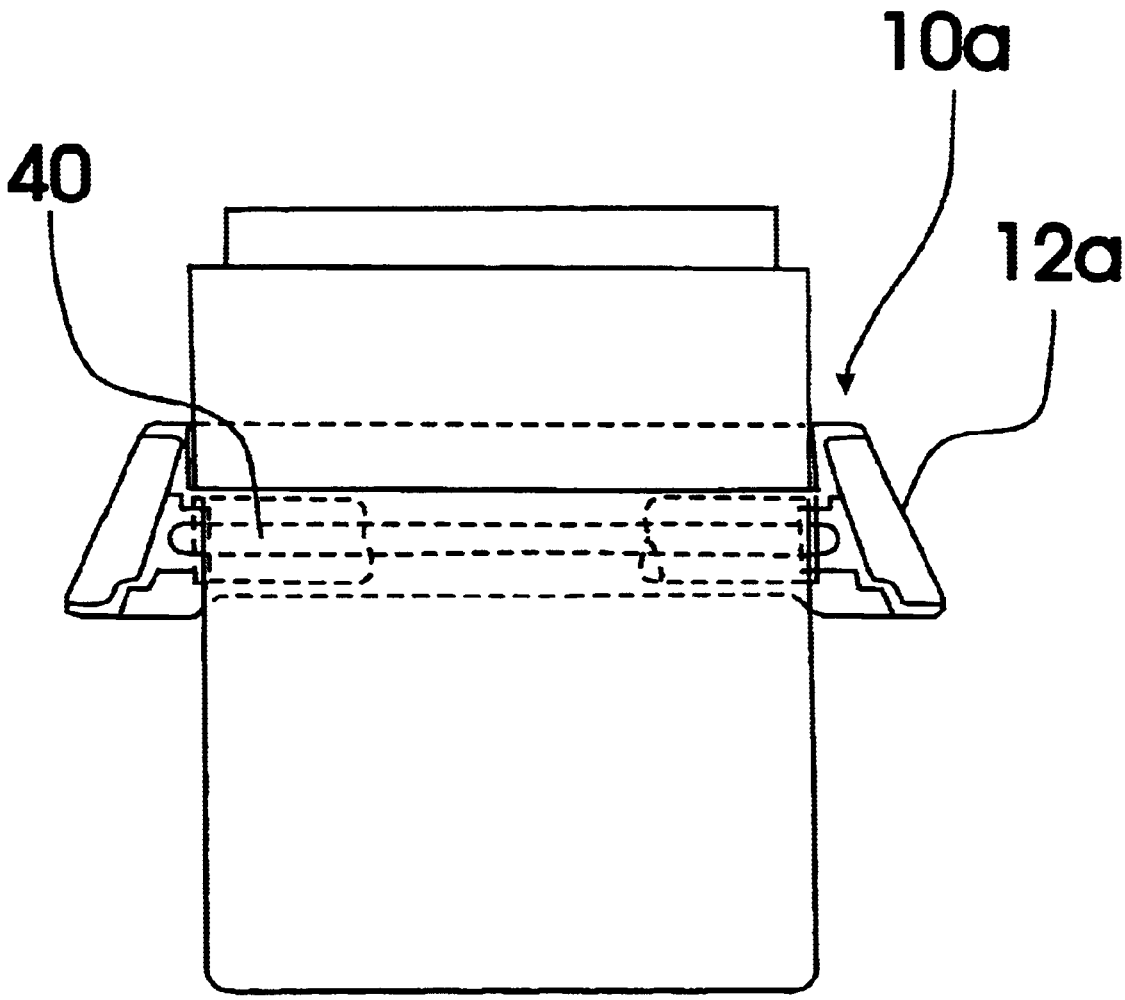
FIG. 3 is the sectional view of the cold care bag system of FIG. 2 along the line A—A.

FIGS. 1–3 show various aspects of an exemplary embodiment of the cold care bag system of the present invention generally designated 10 and 10*a*. Cold care bag system 10 includes a housing 12 for holding tissues 14 and the like that is provided with a mechanism 16 for dispensing cold care bags 18 from a roll 20. Each cold care bag 18 being impregnated with disinfectant material such that a user may use a tissue and dispose of the tissue by putting it in a disinfectant impregnated cold care bag, tearing the cold care bag from the roll, sealing the cold care bag, and throwing the sealed cold care bag into the garbage.

Cold care bag system 10*a* includes a housing 12*a* that includes a cavity 28 that is adapted to receive the bottom portion 30 of a tissue box 32 and which includes a mechanism 16*a* for holding a roll 34 of cold care bags 18 and dispensing them from an access slot 40.

It can be seen from the preceding description that a cold care bag system has been provided.

It is noted that the embodiment of the cold care bag system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cold care bag system comprising:

a housing for holding tissues and the like that is provided with a mechanism for dispensing cold care bags from a roll;

each cold care bag being impregnated with disinfectant material such that a user may use a tissue and dispose of the tissue by putting it in a disinfectant impregnated cold care bag, tearing the cold care bag from the roll, sealing the cold care bag, and throwing the sealed cold care bag into the garbage.

* * * * *